US005924223A

United States Patent [19]

Hone, Jr.

[11] Patent Number: 5,924,223

[45] Date of Patent: Jul. 20, 1999

[54] SNOWPLOW WITH A HYDRAULICALLY ASSISTED MOUNTING SYSTEM

[76] Inventor: Frederick T. Hone, Jr., 339 A S. County Trail, Exeter, R.I. 02822

[21] Appl. No.: 09/095,578

[22] Filed: Jun. 11, 1998

Related U.S. Application Data

[51] Int. Cl.[6] ..... E01H 5/04

[52] U.S. Cl. ..... 37/231; 37/266

[58] Field of Search ..... 37/231, 266

[56] References Cited

U.S. PATENT DOCUMENTS

| | | | |
|---|---|---|---|
| Re. 35,700 | 12/1997 | Watson et al. | 37/231 |
| 3,464,129 | 9/1969 | Bogenschutz . | |
| 3,793,752 | 2/1974 | Snyder . | |
| 4,238,895 | 12/1980 | Hetrick . | |
| 5,075,988 | 12/1991 | Ciula | 37/231 |
| 5,125,174 | 6/1992 | Watson et al. | 37/231 |
| 5,193,296 | 3/1993 | Reilley | 37/231 |
| 5,195,261 | 3/1993 | Vachon | 37/231 |
| 5,353,530 | 10/1994 | Pieper | 37/231 |
| 5,435,082 | 7/1995 | Frenette et al. | 37/231 X |
| 5,485,690 | 1/1996 | MacQueen | 37/231 X |
| 5,647,153 | 7/1997 | Gervais | 37/231 |
| 5,806,213 | 9/1998 | Doornek et al. | 37/231 |
| 5,806,214 | 9/1998 | Behrens et al. | 37/231 |

*Primary Examiner*—Christopher J. Novosad
*Attorney, Agent, or Firm*—Richard C. Litman

[57] ABSTRACT

A snowplow with a hydraulically assisted mounting system is described. The snowplow includes a lifting device that is preferably a hydraulic lift ram. The hydraulic lift ram operates in a plow mode to lift and lower the snowplow onto the ground. In a jack stand mode, the hydraulic lift ram, in conjunction with a removably attachable foot, operates to position the snowplow for effortless mounting onto a vehicle.

9 Claims, 6 Drawing Sheets

SNOWPLOW WITH A HYDRAULICALLY ASSISTED MOUNTING SYSTEM

BACKGROUND OF THE INVENTION

1. Field of the Invention

The present invention relates to a vehicle mountable snowplow, in particular a snowplow having a dual purpose hydraulic arm.

2. Description of the Related Art

A typical vehicle mounted snowplow has cooperating mounts on each the vehicle and the snowplow. Each of the mounts has holes which are brought into registry and secured by a locking pin. However, due to the weight of the snowplow, the holes are difficult to bring into registry manually. As such, a separate device, such as a jack or lever is used to lift the snowplow in order to align the holes. Even with the use of such devices, properly aligning the cooperating mounts typically requires a lot of physical effort on the part of the user.

An example of such device can be found in U.S. Pat. No. 5,125,174, issued Jun. 30, 1992 to Watson et al. The Watson device shows a detachable snowplow blade lift assembly including a mount frame permanently connected to the vehicle frame. The Watson device includes a pivotable lift stand to assist in mounting the snowplow assembly to the vehicle.

Other exemplary inventions, showing structural variations of plows and lift mechanisms, described in the patent literature include U.S. Pat. No. 3,464,129 (Blade and Moldboard Supporting and Adjusting Structure for Snowplows); U.S. Pat. No. 3,793,752 (Convertible Snow Plow with Auxiliary Ground Support); U.S. Pat. No. 4,238,895 (Lift Arm with Improved Chain Connector); U.S. Pat. No. 5,075,988 (Snowplow Quick Mount Lift Assembly); U.S. Pat. No. 5,193,296 (Snow Plow Attachment); and U.S. Pat. No. 5,195,261 (Quick-Hitching Device for Detachably Mounting an Attachment to a Vehicle Frame).

None of the above devices and patents, taken either singularly or in combination, is seen to describe the instant invention as claimed. Therefore, a reduced shock snowplow with a hydraulically assisted mounting system solving the aforementioned problems is desired.

SUMMARY OF THE INVENTION

The present invention is snowplow for use with a motor vehicle, the snowplow having a principle feature comprising a hydraulic arm assembly adapted to be convertible between its conventional operational configuration as a plow lift for use during plowing operations and a second configuration as a jack-stand for adjustably supporting the plow during installation, removal and storage. The basic snowplow structure comprises conventional features including a blade, an A-frame connected to the blade, a vehicle mount connected to the vehicle, a plow mount connected to the A-frame and removably cooperating with the vehicle mount, and a light frame projecting from the A-frame. In order to angularly turn the blade relative to the front of the vehicle, the snowplow has a turning device connected to the blade and to the A-frame. Additionally, the snowplow may further comprise a master cylinder connected to the light frame which contains hydraulic fluid therein and includes auxiliary control switches for operation of the hydraulic system. The snowplow also has a lift arm having a first end and a second end, the first end being pivotally connected to the A-frame. To this lift arm, the hydraulic arm assembly is attached to permit conventional lifting and lowering of the blade during plowing operations.

However, the present snowplow may be configured for use in either a plow mode or a jack stand mode. The snowplow is in the plow mode when the hydraulic arm assembly is connected to the A-frame. More specifically, the convertible hydraulic arm assembly (or also "lifting device" herein), preferably utililizes a hydraulic lift ram in communication with the master cylinder, or other power unit or pump. The hydraulic lift ram comprises a lift cylinder pivotally and removably connected to the A-frame at a first end by a first pin, and a lift piston pivotally connected to the lift arm medially between its first and second ends by a second pin, the lift piston being in telescopic communication with the lift cylinder. The hydraulic lift ram works as do conventional hydraulic systems: when the hydraulic fluid passes from the master cylinder to the lift cylinder, the lift piston telescopes in an outward direction; and when the hydraulic fluid passes from the lift cylinder to the master cylinder, the lift piston telescopes in an inward direction.

The snowplow is in the jack stand mode when the lifting device is partially detached from the A-frame by removing the first pin. A foot is connected to the disconnected end of the lifting device, which pivotally hangs downward when the lifting device is removed from the A-frame to serve as an adjustable jackstand when suitably secured. The foot in the preferred embodiment is removable from the lifting device, however it may be permanently attached. The snowplow also has a foot holder connected to the frame for storing the foot when removed from the lifting device and also positioned for securing the lifting device in the jack stand mode. Thus, the foot may be detached from the foot holder and pivotally and removably connected to the lifting device by means of the first pin. Next, the lifting device is secured to the foot holder. In the jack stand mode, the foot rests on the ground and the lifting device is substantially perpendicular with the ground, which can then be vertically raised or lowered by operating the hydraulic system, in turn raising the entire frame instead of the blade.

It is preferred that the turning device of the snowplow is a pair of hydraulic turn rams in communication with the master cylinder. Each of the hydraulic turn rams comprises a turn cylinder connected to the A-frame, and a turn piston connected to the blade. As with the hydraulic lift ram, the turn rams works as conventional hydraulic systems: when the hydraulic fluid passes from the master cylinder to one of the turn cylinders, the turn piston telescopes in an outward direction; and when the hydraulic fluid passes from one of the turn cylinders to the master cylinder, the turn piston telescopes in an inward direction.

Finally, the snowplow may further include a plurality of light sources which are connected to the light frame. However a fixed light frame has conventionally resulted in misalignment of the light beam each time the plow blade was raised from an operating position. Thus, the present invention provides a light frame pivotally attached and depending upward from the A-frame, and linked to the second end of the lift arm of the light frame by a tether such as a chain. The light sources are mounted on the lift frame and emit a beam of light which is directed in a forward direction over the blade. The light frame being pivotally mounted to the A-frame and bound to the lift arm by the chain permits the light frame to angularly change relative to the A-frame, but generally maintain the same adjustment angle of the lights relative to the ground. Thus, as the blade is raised or lowered by the light frame, the support member maintains a generally vertical relationship raising or lowering the mounted lights without affecting the beam adjustment angle.

Accordingly, it is a principal object of the invention to lessen the effort needed to mount a snowplow onto a vehicle.

It is another object of the invention to provide a light source which follows the movement of the snowplow.

Still another object of the invention is to provide a lifting device which is convertible between a plow mode and a jack stand mode.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
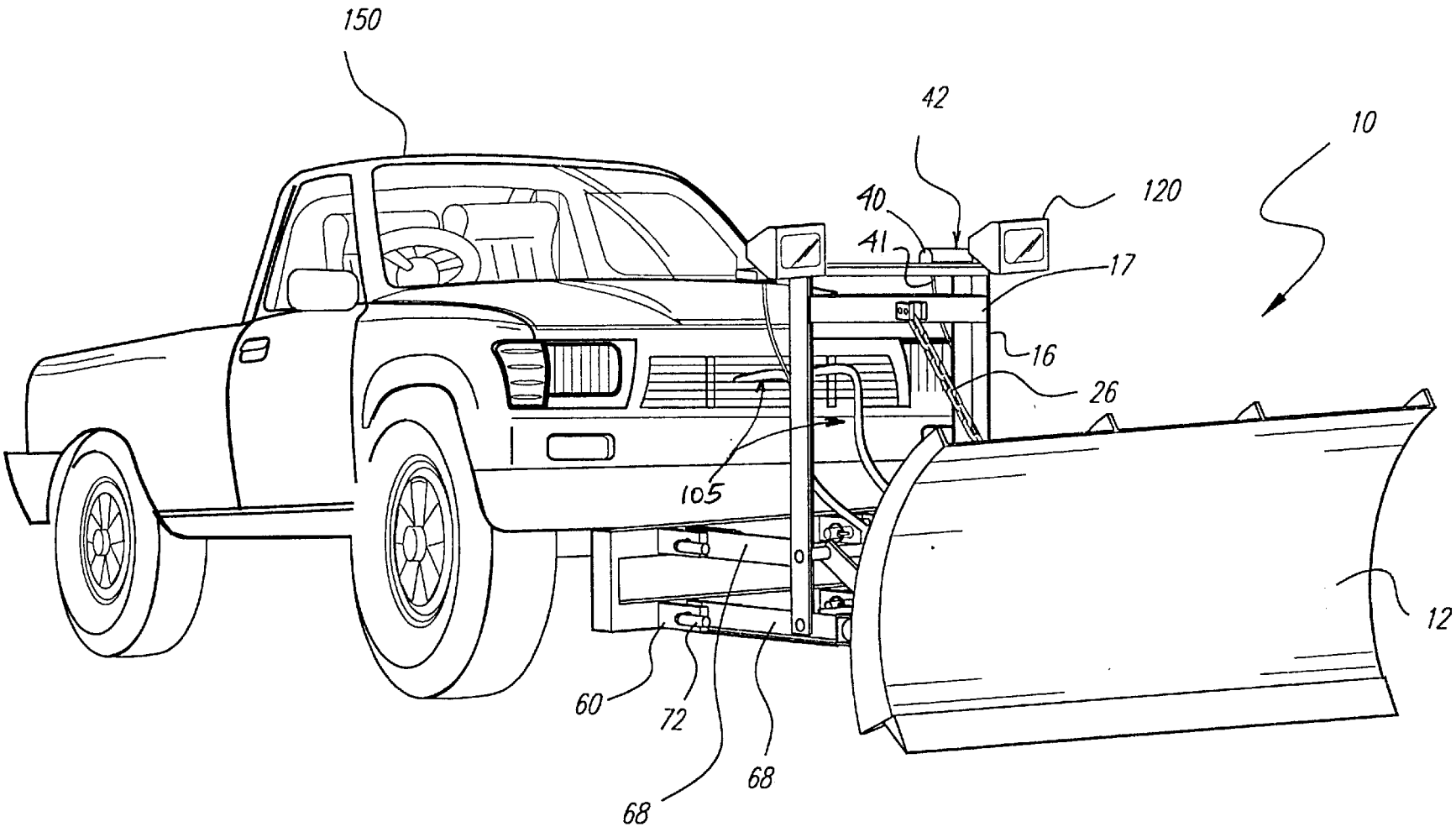
FIG. 1 is an environmental, perspective view of a snowplow with a hydraulically assisted mounting system according to the present invention.
Figure 2:
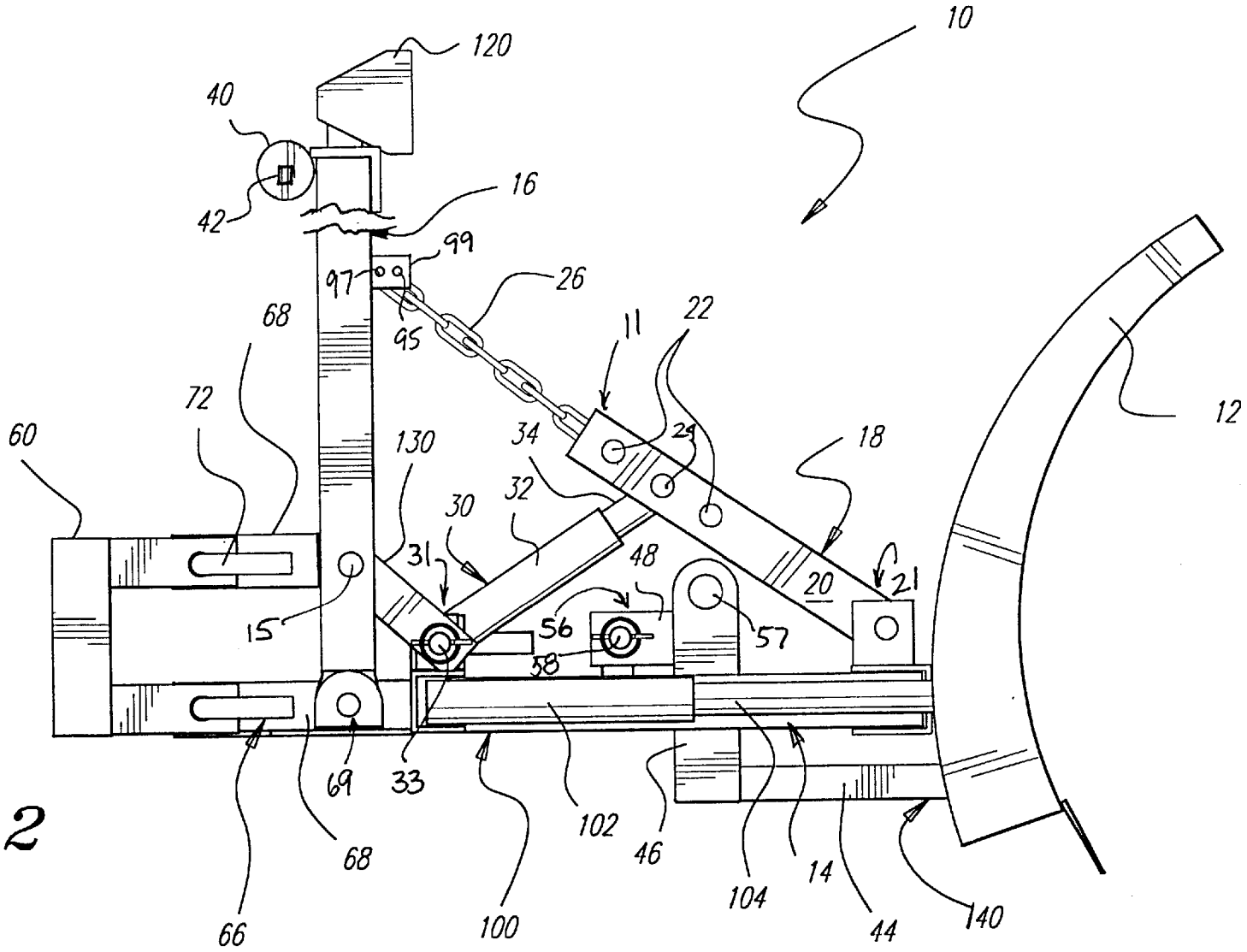
FIG. 2 is a side view of the embodiment of FIG. 1 in the plow mode, showing a fragmented light support member to indicate indefinite length.
Figure 4:
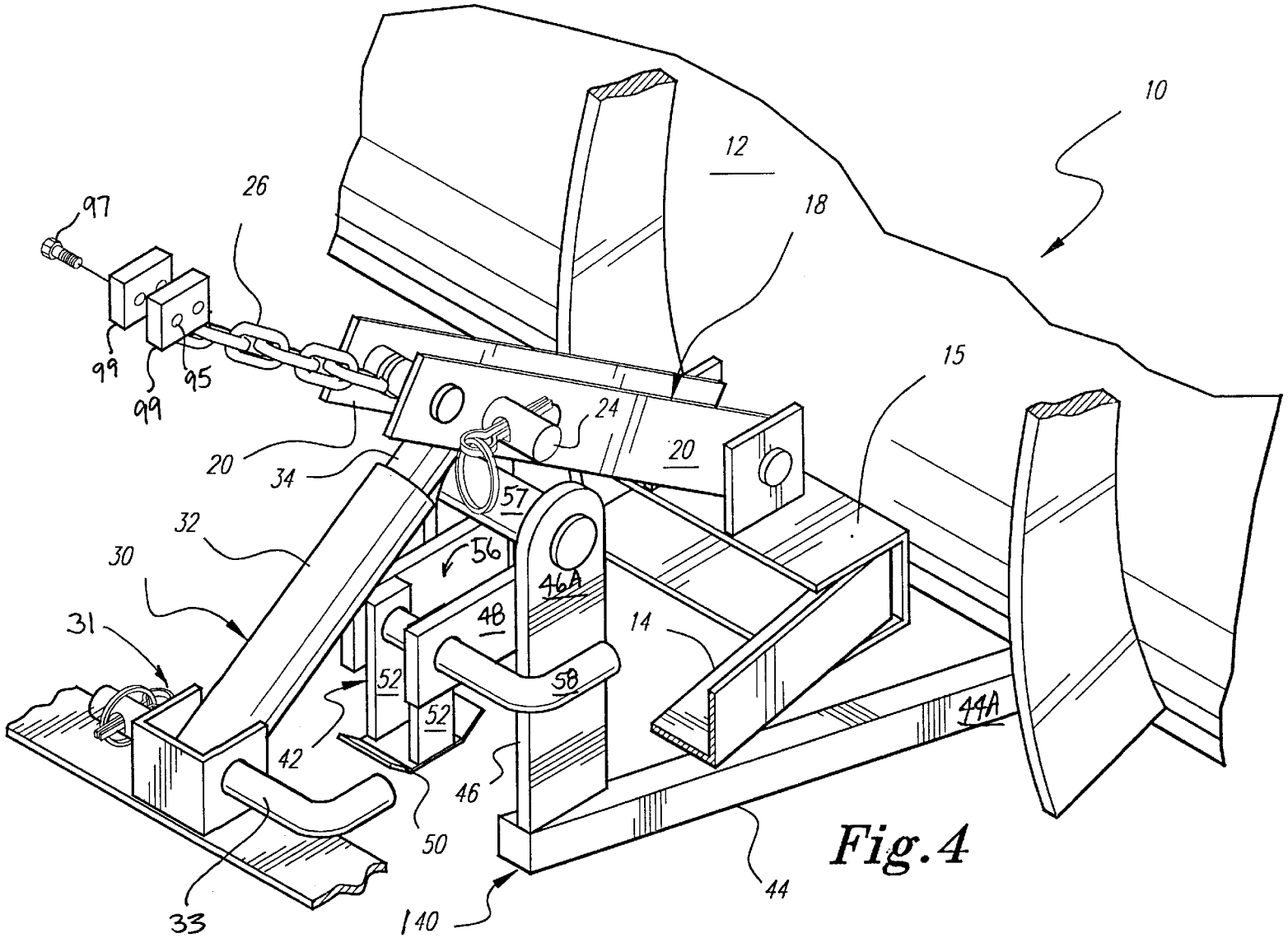
FIG. 4 is a close-up, rear perspective view of the embodiment of FIG. 1 in the plow mode.
Figure 6:
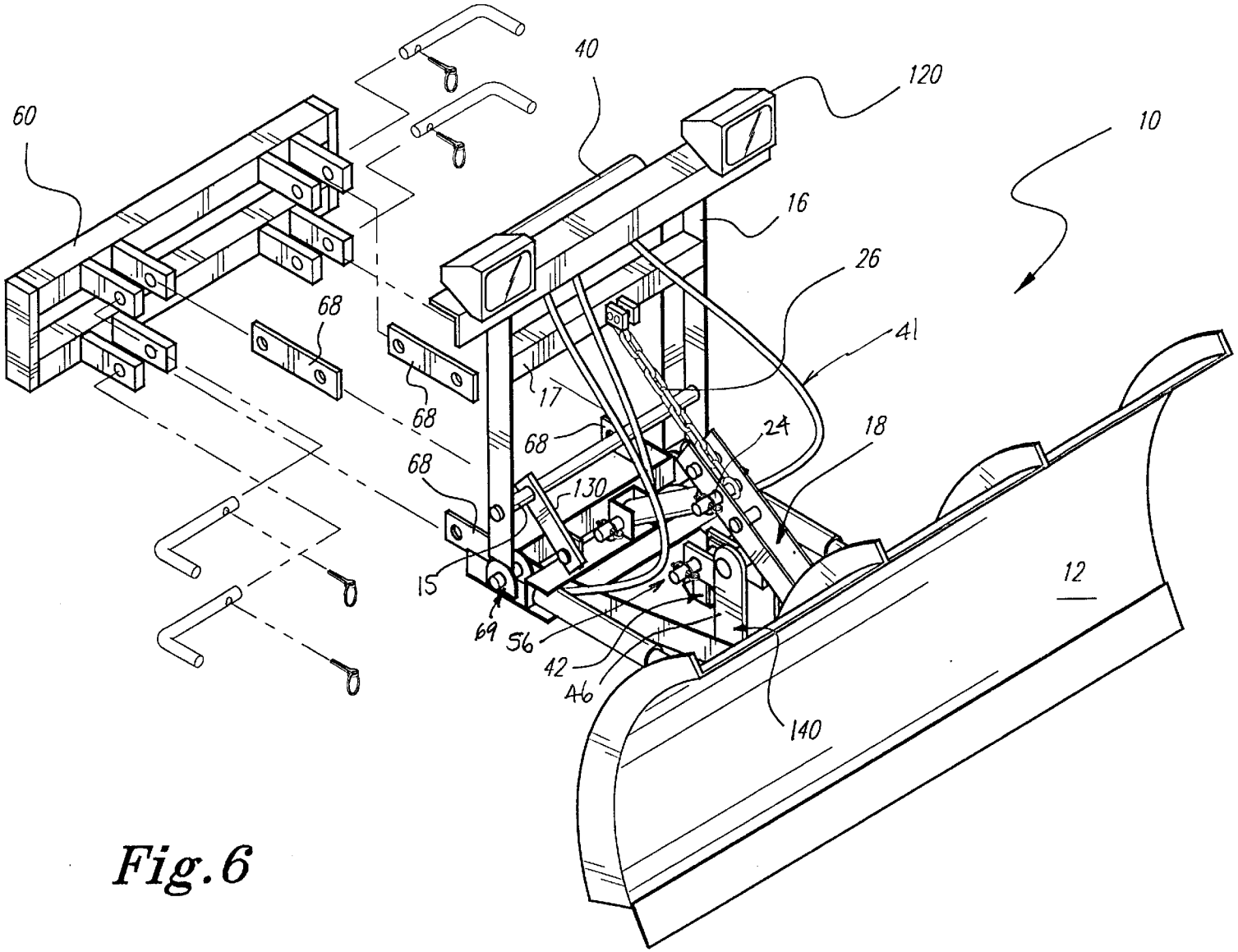
FIG. 6 is a perspective side view of the embodiment of FIG. 1 with the mounts in exploded view.

The present invention, generally referred to as a snowplow 10, is illustrated in FIG. 1 as being mounted to a vehicle 150, such as a pick-up truck. The snowplow 10 is removably attachable to the vehicle 150 and is illustrated in a plow mode. The snowplow 10 includes several conventional features necessary for its operation as a snowplow. Referring to FIGS. 2 and 4, the snowplow 10 comprises a vehicle mount 60 attached to the vehicle 150, an A-frame 14 including a convergence section 15, a light frame 16 projecting from the A-frame 14, and a blade 12 connected to the A-frame 14, at the convergence section 15. The convergence section 15 of the A-frame 14 is the area where two prongs of the "A" meet. The light frame 16 is preferably H-shaped, as illustrated in FIGS. 1 and 6, including a horizontal linker member 17. Referring to FIG. 6, the snowplow 10 has a turning device 100 connected to the blade 12 and the A-frame 14. The turning device 100 turns the blade 12 left and right relative the vehicle 150. It is preferred that the turning device 100 is a pair of hydraulic turn rams 100 which are operatively connected to a power unit or pump 40, such as a master cylinder. Each of the hydraulic turn rams 100 include a turn cylinder 102 and a turn piston 104. The turn piston 104 fits within the turn cylinder 102 and telescopes in and out as conventional hydraulic rams.

FIG. 6 further illustrates the snowplow 10 having a plurality of ears 68 attached to the A-frame 14 and the light frame 16 to form a plow mount 66. The vehicle mount 60 and the plow mount 66 have a plurality of holes which are brought into registry with one another. A plurality of mounting pins 72 fit within the holes, thereby locking the snowplow 10 to the vehicle 150. These holes are typically those which, in conventional snowplows of similar type, must be manually brought into registry with one another in the absence of the convertible lifting device 30 of the present invention.

The snowplow 10 of the present embodiment includes modifications to an arm 18, having a first end 21 and a second end 11, for receiving the lifting device 30, which modifications in part permit the lifting device 30 to be convertible between two modes, the plow mode and the jack stand mode. The first end 21 is pivotally connected to the A-frame 14 proximate the blade 12. The arm 18 is preferably a pair of opposing bars 20 including a plurality of serially spaced and registered holes 22 passing therethrough. The second end 11 is attached by a tether, namely chain 26, to the horizontal linker region 17 of the light frame 16. The linker region 17 includes a pair of tangs 99 each defining a pair of holes 95 through which a removable fastener 97 passes and spaced apart to secure a link of the chain 26 therebetween by passage of the fastener 97.

A visual triangle is thereby generally formed by connections between the light frame 16, A-frame 14 and arm 18 plus chain 26. This configuration substantially shortens the necessary length of chain 26 used as compared to the prior art, and hence lessens the risk of breakage due to repeated slack and strain on the chain caused by passage of the snowplow over uneven surfaces. Stated differently, the shortened chain limits the upward travel of the blade and frame, resulting in less violent stresses upon the chain when the plow drops as road bumps are met by the vehicle with the snowplow, often in a raised condition.

For stability, the light frame 16 includes a stabilizing arm 130 pivotally connected between the A-frame 14 and a shaft 15 spanning the light frame 16. It is preferred that the connections between the stabilizing arm 130, the light frame 16 and the A-frame 14 also form a triangle, wherein the arm 130 is able to pivot about both shaft 15 and a pin assembly 115 depending from A-frame 14.

The snowplow 10 further includes the convertible lifting device 30 for lifting the blade 12 up and lowering the blade 12 down relative to the ground in the plow mode. In the plow mode, the lifting device 30 is connected to the A-frame 14 and the arm 18, and generally bisects the larger triangle described above. In the preferred embodiment, the lifting device 30 is a hydraulic lift ram 30 including a lift cylinder 32 and a lift piston 34, although any similar pneumatic or extensible mechanical device may be substituted. The lift cylinder 32 is pivotally connected by a primary pin assembly 31 to the A-frame 14 proximate to the intersection of the A-frame 14 and light frame 16. The lift piston 34 is pivotally and removably connected to the arm 18, proximate to the second end 11 by a fastener, such as a pin, rod, or nut and bolt assembly. It is preferred that the end of the lift piston 34 includes a hole which is brought into registry with one of the pairs of opposing holes 22 of the arm's bars 20. A rod 24, as shown in FIG. 4, acts as an axle when placed through the holes, thereby pivotally connecting the lift piston 34 to the arm 18.

Figure 3:
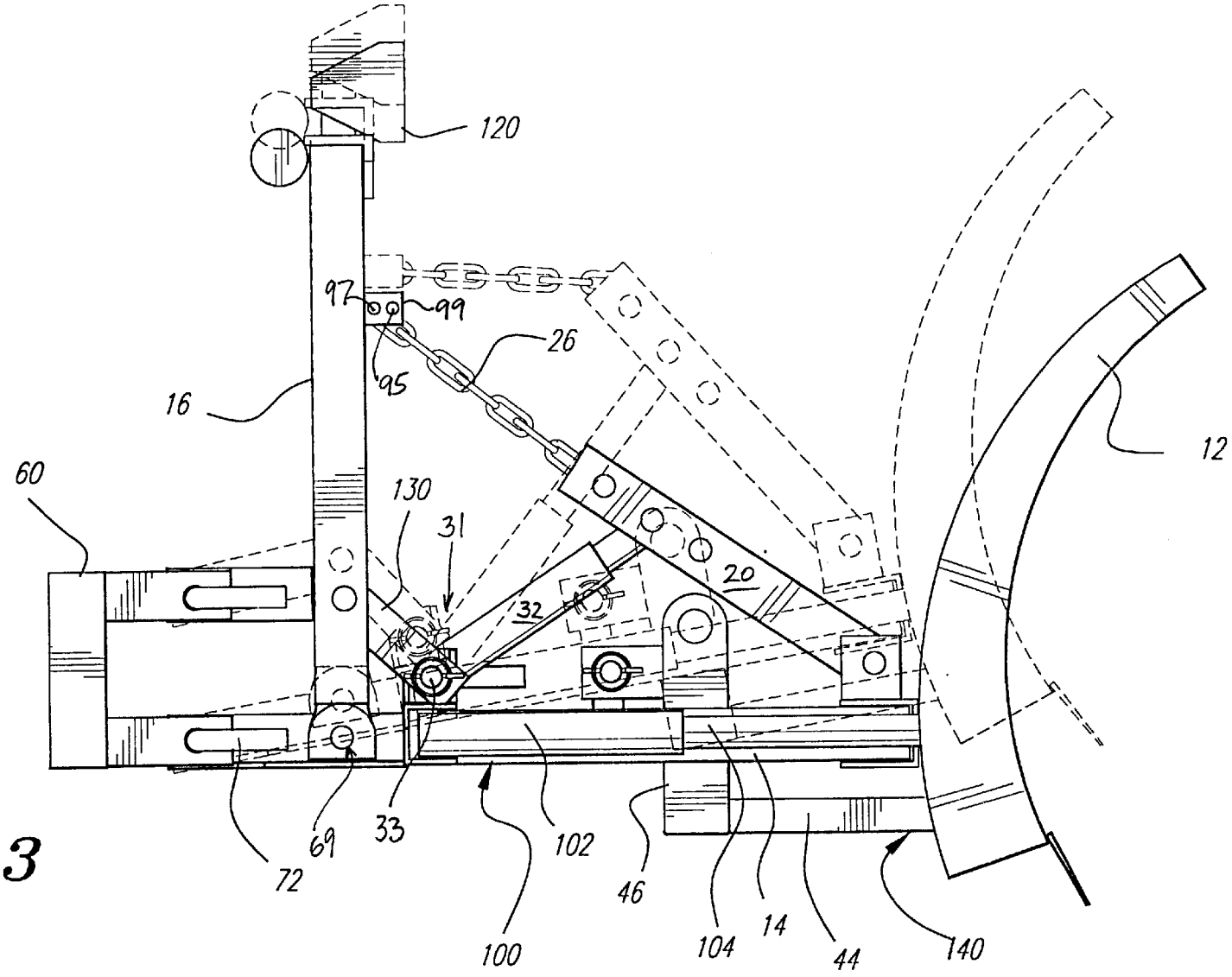
FIG. 3 is a side view of the embodiment of FIG. 1 in the plow mode, particularly illustrating the corresponding movement of the lift piston and the blade and light frame of the snowplow.

The lift piston 34 fits within the lift cylinder 32 and telescopically moves in and out of the lift cylinder 32. The principle of hydraulic lift is commonly known in the art. The lifting device 30 is powered and controlled preferably by conventional hydraulic and electric systems, the electrical connections 105 diagrammed generally leading to the truck electrical system as shown in FIG. 1. The hydraulic system is diagrammatically shown in FIG. 1 including a pump or other power unit, such as master cylinder 40, containing hydraulic fluid therein and appropriate hoses 41 (not shown for clarity in the other Figures). The master cylinder 40 is preferably connected to the top of the light frame 16, and is understood to provide the hydraulic lift ram 30 with the hydraulic fluid that is necessary for the lift piston 34 to telescope in and out of the lift cylinder 32. An electrical switch 42, preferably located proximate to the power unit, e.g. master cylinder 40, (FIG. 2) provides a means for controlling the flow of hydraulic fluid to and from the hydraulic lift ram 30. A person skilled in the hydraulic art may set up the connections between the master cylinder 40 and the hydraulic lift ram 30 in any manner to accomplish the hydraulic lift ram's 30 purpose. FIG. 3 illustrates how, as the lift piston 34 telescopes outwardly from the lift cylinder 32, the snowplow 10 lifts upwardly in the plow mode, and, in addition, shows how the light frame 16 and blade 12 move in unison.

Unlike its conventional counterparts, the lifting device 30 can also be converted into a jack stand mode in order to facilitate mounting or dismounting the snowplow 10 to or from the vehicle 150. To permit the jackstand mode, the snowplow 10 further includes a foot holder 140 attached to the blade 12. The foot holder 140 includes a securing portion 56 for securing the lifting device 30 in the jack stand mode, and is positioned to maintain the lifting device 30 in a generally vertical orientation while the A-frame 14 rests generally horizontally. Referring to the FIGS. 4 and 5, the preferred embodiment of the foot holder 140 comprises a pair of L-shaped members each with a horizontal member 44 and a vertical member 46. Each of the horizontal and vertical members 46 include a first end 44A,46A, respectively. The first ends 44A of the horizontal members 44 are attached to the blade 12. The first end 46A of the vertical members 46 project upwardly from the horizontal members 44 and define a free end which forms a rest 57 or stop for lift arm 18 in its lowermost position. Depending perpendicularly from the first end 46A, is the securing portion 56 for trapping or otherwise securing the lifting device 30 in a vertical orientation.

Figure 5:
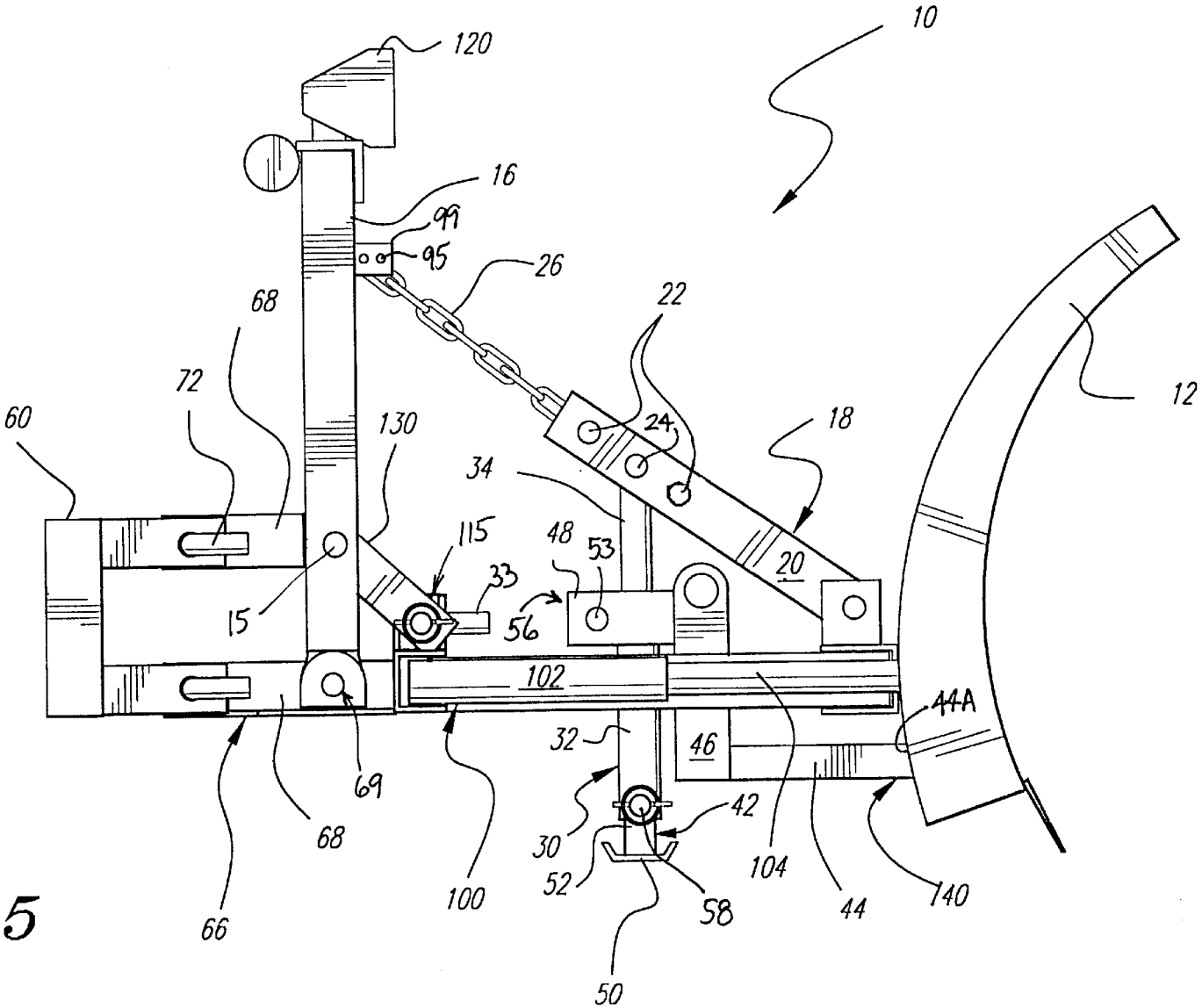
FIG. 5 is a side view of the embodiment of FIG. 1 in the jack stand mode.

FIG. 5 illustrates the preferred embodiment of the securing portion 56 as a pair of tabs 48 projecting horizontally away from the vertical members 46 and towards the vehicle 150, and spaced to permit close confinement of the lift cylinder 32. Each of the tabs 48 includes a hole 53 therethrough through which a pin 58 passes, the pin 58 completing the enclosure for the lift cylinder 32.

Moreover, the securing portion 56 as configured performs a dual purpose. A foot 42 for attachment to the lifting device 30 is configured and dimensioned to be removably stored on the foot holder 140 while the snowplow 10 is in the plow mode. Referring to FIG. 4, the foot 42 preferably comprises a sole plate 50 having two ends, a bottom side which contacts the ground in the jack stand mode and a top side. The ends of the sole plate 50 are bent upwardly to accommodate an uneven surface upon which the bottom side of sole plate 50 rests. A pair of opposing walls 52 project upwardly from the top side of the surface 50. The upper portions of the walls 52 include a hole therethrough, each of which are aligned in registry with the holes of the securing portion tabs 48, through which pin 58 is passed.

When in the plow mode, the foot 42 is stored on the foot holder 140. It should be understood that other configurations of the securing portion 56 which trap the lifting device 30 in a substantially vertical orientation may be contemplated, and that the use of the securing portion 56 for a dual purpose is not necessary.

Thus, in order to place the snowplow 10 in the jack stand mode, the lift cylinder 32 is detached from the A-frame 14 by removing the primary pin 33 from the primary pin assembly 31 attached to the A-frame 14. The primary pin assembly 31 may comprise a simple pair of forks extending upward from the A-frame and define a pair of holes in registry through which the pin 33 passes. The foot 42 is removed from the foot holder 40 by removing pin 58 and is pivotally reattached to the lift cylinder 32 using pin 58 at the point where the lift cylinder 32 was attached to the A-frame 14 in the plow mode. In an alternative embodiment, the foot 42 is permanently attached to the lifting device in the same position as shown in FIG. 5. As is conventional in the hydraulic arts, lift rams presently are configured to include cylindrical passages which are adapted for use with pins, bolts and similar fasteners f or attachment to frames, and may be used f or the present purpose. In the alternative embodiment in which the foot is permanently affixed, the foot may simply be welded to such a ram.

Furthermore, as can be best appreciated from FIG. 5, the hydraulic lift ram 30 is positioned to be substantially perpendicular to the ground, and substantially freely hanging from the lift arm 18 by force of gravity though trapped by securing portion 56. The foot 42, being attached to the lift ram 30 by pin 58, is positioned to rest on the ground. Thus, as the lift piston 34 telescopes out from the lift cylinder 32 by conventional operation of the controls, such as by switch 42, the snowplow 10 is vehicle mount 60 and the plow mount 66 into registry. When this is accomplished, the mounting pins 72 are inserted into the holes, thereby locking the vehicle mount 60 to the plow mount 66 of the snowplow 10.

The snowplow 10 also includes a plurality of lights 120 preferably attached to the top of the light frame 16. A beam of light emits from the plurality of lights 120 in a forward direction, relative to the front of the vehicle 150. Each light source 120 is mounted on the lift frame to emit a beam of light which is directed in over the blade 12. The light frame 16 is pivotally attached by pivot assembly 69 and depending upward from the A-frame 14, and linked to the second end of the lift arm of the light frame by a tether such as a chain as described above. Thus, being pivotally mounted to the A-frame 14 and bound to the lift arm 18 by the chain 26 permits the light frame 16 to angularly change relative to the A-frame 14, but generally maintain the same adjustment angle of the light source 120 relative to the ground. Thus, as the blade 12 is raised or lowered by the light frame 16, the light frame 16 maintains a generally vertical relationship raising or lowering the mounted lights 120 without affecting the beam adjustment angle. The light frame 16 is shown of indeterminant length in FIG. 2, because it may be lengthened or shortened as necessary to consider both the blade lift height and the possible obstruction by the lights 120 of a driver's view. Likewise, the pivot assembly 69 of light frame 16 may be positioned forward or rearward relative to the A-frame 14 to determine the proper amount of vertical rise necessary for a given light frame height to clear the blade 12 when lifted.

It is to be understood that the present invention is not limited to the embodiment described above, but encompasses any and all embodiments within the scope of the following claims.

I claim:

1. A snowplow for use with a motor vehicle, the snowplow comprising:

a blade;

an A-frame operably connected to said blade;

a plow mount connected to said A-frame, said plow mount adapted to removably connect to the motor vehicle;

an arm for raising and lowering said blade, having a first end and a second end, said first end being pivotally connected to said A-frame;

an extensible lifting device pivotally and removably connected to said A-frame and pivotally connected to said arm, thereby defining a plow mode configuration, wherein when said lifting device is disconnected from said A-frame, a jack stand mode is defined, wherein said lifting device depends pivotally and vertically downward from said arm;

a light frame projecting upward from said A-frame;

a power unit connected to said light frame for driving said extensible lifting device, wherein said power unit is a master cylinder containing hydraulic fluid therein;

wherein said extensible lifting device is a hydraulic lift ram in operable communication with said power unit, said hydraulic lift ram comprising a lift cylinder and a lift piston one removably connected to said A-frame and the other pivotally connected to said arm, said lift piston being in telescopic communication with said lift cylinder; and a foot holder connected to said blade, said foot holder having a securing portion adapted and positioned for receiving and removably securing said extensible lifting device in the jack stand mode.

2. The snowplow according to claim 1, further comprising a turning device for laterally turning said blade, wherein said turning device is a pair of hydraulic turn rams in communication with said master cylinder, each of said hydraulic turn rams comprises:

a turn cylinder and a turn piston, one connected to said A-frame and the other connected to said blade.

3. The snowplow according to claim 1, further comprising a plurality of light sources connected to said light frame, wherein said plurality of light sources emit a beam of light, said beam of light being directed in a forward direction over said blade.

4. The snowplow according to claim 3, further comprising a pivot assembly attaching said light frame to said A-frame, and a tether connected between said second end of said arm and said light frame at a point minimizing a length of said tether, whereby an angular change of said plurality of light sources relative to said A-frame is permitted thereby minimizing a directional change of an emitted light beam.

5. The snowplow according to claim 1, further comprising a foot removably connected to and for supporting said extensible lifting device upon a ground surface in the jack stand mode.

6. The snowplow according to claim 5, wherein said foot is adapted to be removably connected to said securing portion of said foot holder, wherein when in a plow mode, said foot is removably secured to said foot holder.

7. The snowplow according to claim 1, wherein said plow mount defines at least one mounting hole and includes a mating vehicle mount for affixing to said motor vehicle defining a corresponding hole which when brought into registry with said at least one mounting hole permits passage of a fastening pin.

8. The snowplow according to claim 1, further comprising a foot permanently affixed to and for supporting said extensible lifting device upon a ground surface in the jack stand mode.

9. A snowplow for use with a motor vehicle, the snowplow comprising:

a blade;

an A-frame operably connected to said blade;

a plow mount connected to said A-frame, said plow mount adapted to removably connect to the motor vehicle;

an arm for raising and lowering said blade, having a first end and a second end, said first end being pivotally connected to said A-frame;

an extensible lifting device pivotally and removably connected to said A-frame and pivotally connected to said arm, thereby defining a plow mode configuration, wherein when said lifting device is disconnected from said A-frame, a jack stand mode is defined, wherein said lifting device depends pivotally and vertically downward from said arm;

a light frame projecting upward from said A-frame;

a power unit connected to said light frame for driving said extensible lifting device;

a plurality of light sources connected to said light frame, wherein said plurality of light sources emit a beam of light, said beam of light being directed in a forward direction over said blade;

a pivot assembly attaching said light frame to said A-frame, and a tether connected between said second end of said arm and said light frame at a point minimizing a length of said tether, whereby an angular change of said plurality of light sources relative to said A-frame is permitted thereby minimizing a directional change of an emitted light beam, wherein said tether is a chain removably and adjustably attached to said light frame; and a foot holder connected to said blade, said foot holder having a securing portion adapted and positioned for receiving and removably securing said extensible lifting device in the jack stand mode.

* * * * *